United States Patent [19]

Ritchie

[11] 4,008,987

[45] Feb. 22, 1977

[54] COMBINED TIMING GEAR AND PUMP FOR ROTARY MECHANISMS

[75] Inventor: James A. Ritchie, Solihull, England

[73] Assignee: Caterpillar Tractor Co., Peoria, Ill.

[22] Filed: Jan. 7, 1976

[21] Appl. No.: 647,296

[52] U.S. Cl. ..... 418/53; 418/76; 418/88; 418/94

[51] Int. Cl.[2] ..... F01C 1/02; F01C 21/04; F04C 29/02

[58] Field of Search ..... 418/49–53, 418/61 A, 76, 77, 88, 94, 170, 63

[56] References Cited

UNITED STATES PATENTS

| | | | |
|---|---|---|---|
| 3,117,527 | 1/1964 | Messmer | 418/77 |
| 3,234,921 | 2/1966 | Laing et al. | 418/88 |
| 3,492,974 | 2/1970 | Kreimeyer | 418/53 |
| 3,583,371 | 6/1971 | King | 418/88 |
| 3,938,477 | 2/1976 | Miller et al. | 123/8.07 |

*Primary Examiner*—John J. Vrablik
*Attorney, Agent, or Firm*—Wegner, Stellman, McCord, Wiles & Wood

[57] ABSTRACT

A rotary mechanism including a housing defining an operating chamber, a shaft journalled in the housing and having an eccentric within the chamber, a rotor within the chamber and journalled on the eccentric, a timing gear carried by the housing and within the chamber and having a predetermined number of teeth, an internal ring gear carried by the rotor and meshed with the timing gear, the ring gear having a number of teeth greater than the predetermined number of the timing gear whereby a crescent-shaped gap between the gears exist. A crescent-shaped pad is carried by the eccentric within the gap and an inlet port is provided in the eccentric adjacent one corner of the pad for supplying hydraulic fluid to the gap. An outlet port is located in the eccentric adjacent the other corner of the pad for conveying pressurized hydraulic fluid to a point of use within the mechanism. The invention provides high pressure hydraulic fluid through unique use of the timing and ring gears necessary in such mechanisms.

6 Claims, 4 Drawing Figures

Fig. 1.
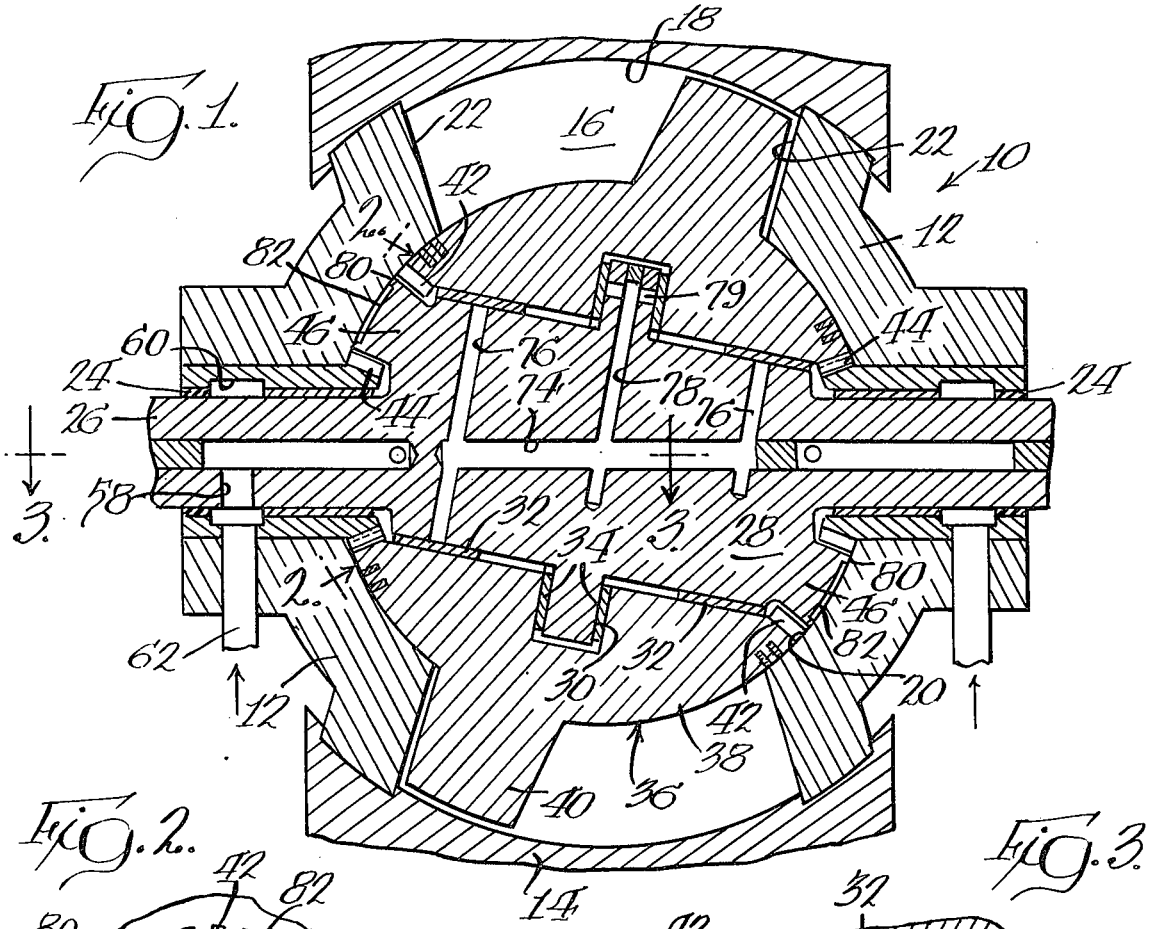
Fig. 2.
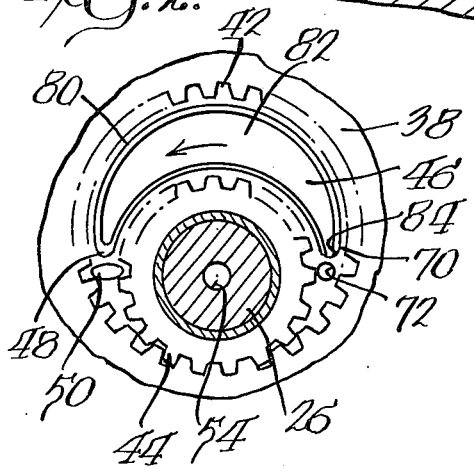
Fig. 3.
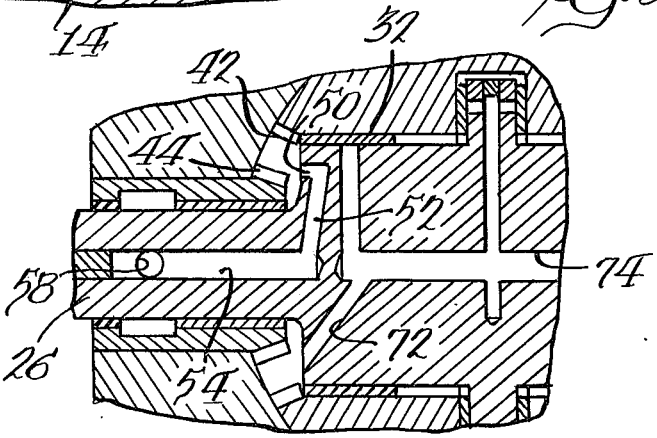
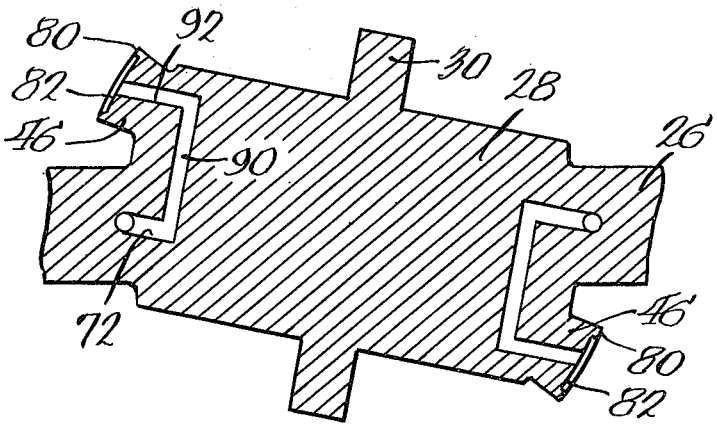
Fig. 4.

COMBINED TIMING GEAR AND PUMP FOR ROTARY MECHANISMS

BACKGROUND OF THE INVENTION

This invention relates to rotary mechanisms such as engine, compressors, pumps, or the like. More particularly, it relates to such mechanisms wherein the rotor is provided with an internal ring gear meshed with a timing gear carried by the mechanism housing.

There are a number of situations wherein it is desirable to have hydraulic fluid under unusually high pressures available within the main shaft of a rotary mechanism. For example, in the slant axis rotary type of rotary mechanism, thrust bearings are employed and if the thrust bearings are to operate as hydrostatic bearings, high pressure oil must be used.

As is well known, it is extremely inconvenient to seal a high pressure conduit extending from a fixed source to a rotary member in an economical way. As a consequence, in a practical sense, the use of hydrostatic bearings in such rotary mechanisms has been precluded.

SUMMARY OF THE INVENTION

It is the principal object of the invention to provide an apparatus including means for generating high oil pressures within the rotating members of rotary mechanisms themselves thereby obviating the difficulties encountered when rotary unions are employed.

An exemplary embodiment of the invention achieves the foregoing object in a rotary mechanism including a housing defining an operating chamber. A shaft is journalled in the housing and has an eccentric within the chamber and a rotor is within the chamber and journalled on the eccentric. A timing gear is carried by the housing within the chamber and has a predetermined number of teeth, while an internal ring gear is carried by the rotor and is meshed with the timing gear. The ring gear has a greater number of teeth than the timing gear so that a crescent-shaped gap between the gear exists. A crescent-shaped pad is carried by the eccentric and is disposed within the gap. An inlet port is disposed in the eccentric adjacent one corner of the pad for supply hydraulic fluid, normally oil, to the gap and an outlet port is located in the eccentric adjacent the other corner of the pad for conveying the pressurized fluid to a point of use within the mechanism.

According to a modified embodiment of the invention, the gears, pad and ports are provided at both ends of the eccentric.

In a highly preferred embodiment of the invention, the shaft includes a hydrostatic thrust bearing and is provided with an internal conduit extending from the outlet port to the thrust bearing. Typically, the thrust bearing will include a thrust collar having opposed faces disposed between bearings and the conduit includes delivery ports in the faces enabling the thrust bearing to act as a hydrostatic bearing.

According to another embodiment of the invention, journal bearings are provided for journalling the shaft within the housing and the rotor on the shaft. The point of use to which oil or hydraulic fluid under pressure is conveyed from the oil outlet includes at least some of the journal bearings.

In still another embodiment of the invention, the top surface of the pad includes a recess facing a wall of the housing and means are provided for directing pressurized hydraulic fluid to the recess so that the pad acts as a hydrostatic thrust bearing. In one embodiment, the directing means includes a conduit connected to the outlet port, while in another embodiment, the directing means comprises a groove in the top surface of the pad at the corner adjacent the outlet extending into the recess so that the pressurized hydraulic fluid is directed to the recess.

Other objects and advantages will become apparent from the following specification taken in connection with the accompanying drawings.

DESCRIPTION OF THE DRAWINGS

FIG. 1 is a sectional view of a rotary mechanism, specifically, a slant axis rotary engine, made according to the invention;

FIG. 2 is a fragmentary, sectional view taken approximately along the line 2—2 of FIG. 1;

FIG. 3 is a fragmentary, sectional view taken approximately along the line 3—3 of FIG. 1; and FIG. 4 is a fragmentary, sectional view of a portion of a mechanism made according to a modified embodiment of the invention.

DESCRIPTION OF THE PREFERRED EMBODIMENTS

An exemplary embodiment of a rotary mechanism made according to the invention is illustrated in FIG. 1 in the form of a four-cycle, slant axis rotary engine. However, it is to be understood that the invention is not limited to use in mechanisms performing as engines, but will find utility in pumps, compressors, or the like. It is also to be understood that the invention is not limited to slant axis rotary mechanisms, but will find utility in other forms of mechanisms, such as trochoidal mechanisms or any other rotary mechanism wherein a rotor carries an internal ring gear meshed with a timing gear carried by the housing. It will also be appreciated that the invention is useful in mechanism operating on other than four-cycle principles as, for example, two-cycle mechanisms.

The rotary mechanism is seen to include a housing, generally designated 10, defined by end members 12 and an intermediate member 14. The members 12 and 14 define an operating chamber 16 bounded by a radially outer spherical wall 18, a radially inner spherical wall 20 and opposed, interconnecting, generally radially extending side walls 22.

Each of the end housings 12 carries a journal bearing 24 which, in turn, journals a shaft 26 in the housing. The shaft 26 includes an angularly offset portion or eccentric 28 which is disposed within the chamber 16. The eccentric 28 includes a peripheral thrust collar 30 and by means of journal bearings 32 and bearing elements 34 forming part of a thrust bearing together with the thrust collar 30, a rotor, generally designated 36, is journalled on the eccentric 28.

As is well known, a rotor in a slant axis rotary mechanism includes a spherical hub 38 and a peripheral flange 40. Seals are provided in the conventional fashion and, at at least one end of the spherical hub 38, the rotor 36 is provided with an internal ring gear 42. As illustrated in FIG. 1, one such internal ring gear 42 is provided at each end of the hub 38.

The housing 10, at at least one end thereof, carries a timing gear 44 which is meshed with the internal ring gear 42. As illustrated in FIG. 1, a timing gear 44 is provided at each end of the housing.

The gears set the relative rates of rotation of the shaft 26 and the rotor 36. Typically, in a four-cycle mechanism, the ratio will be such that there will be three revolutions of the shaft 26 for each revolution of the rotor 36. In any event, in every instance, the number of teeth in the ring gear 42 will be greater than the number of teeth in the timing gear 44 with the result that there will be a crescent-shaped gap between the two. As seen in FIGS. 1 and 2, the gap is filled with a crescent-shaped pad or island 46 carried by the eccentric 28 on a corresponding end thereof. As a result, a gear pump configuration is defined.

More specifically, adjacent one corner 48 of the pad 46, an inlet port 50 is located. As seen in FIG. 3, a radial bore 52 connects the port 50 with an axial bore 54 in the shaft 26. A further radial bore 58 in the shaft (FIG. 1) extends to an annular port 60 which is connected by a conduit 62 to the usual oil pump. Thus, relatively low pressure oil, typically 40 – 100 psig, is directed to the gear pump via the inlet 50.

Opposite the other corner 70 of the pad 46 there is disposed an outlet port 72, also in the eccentric 28. The outlet port 72, as best seen in FIG. 3, extends to an axial conduit 74 in the eccentric and separate from the bore 54. As seen in FIG. 1, a plurality of radially extending bores 76 connect the bore 74 to the journal bearings 32 whereby lubricating oil may be delivered thereto. In addition, a radially extending bore 78 extends to a cross conduit 79 in the thrust collar 30 for directing lubricating oil to both faces of the thrust collar 30 to enable the same to act as a hydrostatic bearing. In other words, the pump defined by the gears 42 and 44 and the pad 46 as well as the inlet 50 and outlet 72 acts as a booster pump for raising the pressure of the oil from the usual, relatively low pressure available to a sufficiently high pressure so as to enable the use of bearings acting on the hydrostatic principle without requiring external connections for the high pressure lubricant.

As seen in FIG. 1, the pump at the left-hand end of the shaft is employed to supply lubricant to the journal and thrust bearings for the rotor. The pump at the right-hand end of the shaft, through appropriate conduiting, could also be made to serve such bearings. Alternately, the same, through appropriate conduits located in the shaft, could provide high pressure oil to the usual thrust bearing (not shown) disposed between the shaft and the housing in a slant axis rotary mechanism to enable that bearing to operate on the hydrostatic principle as well.

The invention also contemplates that the pads 46 themselves can be employed as hydrostatic thrust bearings. As seen in FIGS. 1, 2 and 4, the top surface 80 of each of the pads 46 is provided with a recess 82. To this recess 82, oil under high pressure as an output from the pump defined by the gears 42, 44, pad 46 and inlet 50, is directed. In the embodiment illustrated in FIG. 2, a small groove 84 is located in the surface 80 and extends into the recess 82 at the corner adjacent the outlet port 72. Thus, the high pressure oil at the outlet will be directed, without further conduiting to the recess 82.

FIG. 4 illustrates an alternate embodiment wherein a radial conduit 90 extends from the output 72 to a conduit 92 which opens in the recess 82. Accordingly, oil under high pressure can be directed to the recess 82 via the port 72 and conduits 90 and 92.

In general, when it is desired to use the pad 46 as a thrust bearing, the same will be employed on both ends of the eccentric and then in uses where the total thrust is relatively small as, for example, in air compressors.

From the foregoing, it will be appreciated that a rotary mechanism made according to the invention achieves the objects previously stated in providing for a source of oil or hydraulic fluid under high pressure within the shaft and without the need for rotary unions. It will also be appreciated that the invention uniquely takes advantage of the presence of elements required for operation of the mechanism in any event, namely, the timing gear and internal ring gear.

What is claimed is:

1. In a rotary mechanism, the combination of:

a housing defining an operating chamber;

a shaft journalled in said housing and having an eccentric within said chamber;

a rotor within said chamber and journalled on said eccentric;

a timing gear carried by said housing and within said chamber and having a predetermined number of teeth;

an internal ring gear carried by said rotor and meshed with said timing gear, said ring gear having a number of teeth greater than said predetermined number whereby a crescent-shaped gap between said gears will exist;

a crescent-shaped pad carried by said eccentric within said gap;

an inlet port in said eccentric adjacent one corner of said pad for supplying hydraulic fluid to said gap; and an outlet port in said eccentric adjacent the other corner of said pad for conveying pressurized hydraulic fluid to a point of use within said mechanism;

said shaft including a hydrostatic thrust bearing and a conduit in said shaft extending from said outlet port to said thrust bearing.

2. The rotary mechanism of claim 1 wherein said thrust bearing includes a thrust collar having opposed faces disposed between bearings, and said conduit includes delivery ports in said faces.

3. In a rotary mechanism, the combination of:

a housing defining an operating chamber;

a shaft journalled in said housing and having an eccentric within said chamber;

a rotor within said chamber and journalled on said eccentric;

a timing gear carried by said housing and within said chamber and having a predetermined number of teeth;

an internal ring gear carried by said rotor and meshed with said timing gear, said ring gear having a number of teeth greater than said predetermined number whereby a crescent-shaped gap between said gears will exist;

a crescent-shaped pad carried by said eccentric within said gap;

an inlet port in said eccentric adjacent one corner of said pad for supplying hydraulic fluid to said gap; and an outlet port in said eccentric adjacent the other corner of said pad for conveying pressurized hydraulic fluid to a point of use within said mechanism;

a surface of said pad including a recess facing a wall of said housing, and means for directing pressurized hydraulic fluid to said recess whereby said pad may act as a hydrostatic thrust bearing.

4. The rotary mechanism of claim 3 wherein said directing means includes said outlet port.

5. The rotary mechanism of claim 3 wherein said directing means comprises a groove in said pad surface at said other corner extending into said recess.

6. The rotary mechanism of claim 3 wherein said crescent-shaped pad extends from a side of said eccentric, and wherein said surface is disposed on the pad oppositely from the eccentric to face a wall on said housing, said recess being generally crescent-shaped, and wherein said directing means comprises a groove in said surface at said other corner and extending into said recess.

* * * * *